US006999050B2

(12) United States Patent
Hung et al.

(10) Patent No.: US 6,999,050 B2
(45) Date of Patent: Feb. 14, 2006

(54) APPARATUS FOR RECYCLING ENERGY IN A LIQUID CRYSTAL DISPLAY

(75) Inventors: Kun-Cheng Hung, Hsinchu (TW); Lin-Kai Bu, Tainan (TW)

(73) Assignee: Chi Mei Opetoelectronics Corp. (TW)

( * ) Notice: Subject to any disclaimer, the term of this patent is extended or adjusted under 35 U.S.C. 154(b) by 374 days.

(21) Appl. No.: 10/284,250

(22) Filed: Oct. 31, 2002

(65) Prior Publication Data

US 2003/0117387 A1 Jun. 26, 2003

(30) Foreign Application Priority Data

Dec. 24, 2001 (TW) ..... 90132094 A

(51) Int. Cl.
*G09G 3/36* (2006.01)
*G09G 3/28* (2006.01)

(52) U.S. Cl. ..... 345/87; 345/98; 345/211; 345/100; 345/94

(58) Field of Classification Search ..... 345/58, 345/60, 87, 94, 98, 100, 211, 212, 213, 215, 345/214, 95, 96, 205, 207; 363/26
See application file for complete search history.

(56) References Cited

U.S. PATENT DOCUMENTS 4,217,632 A * 8/1980 Bardos et al. ..... 363/17
5,528,256 A * 6/1996 Erhart et al. ..... 345/96
5,646,832 A * 7/1997 Pulhamus et al. ..... 363/24
6,144,357 A * 11/2000 Jeong ..... 345/100
6,144,564 A * 11/2000 Fraidlin et al. ..... 363/16
6,154,380 A * 11/2000 Assow et al. ..... 363/61
6,275,208 B1 * 8/2001 Park ..... 345/94
6,407,483 B1 * 6/2002 Nunuparov et al. ..... 310/339
6,538,647 B1 * 3/2003 Chen et al. ..... 345/211
6,559,821 B1 * 5/2003 Ichikawa et al. ..... 345/92
6,633,272 B1 * 10/2003 Kumagawa et al. ..... 345/98
2002/0033806 A1 * 3/2002 Vossen et al. ..... 345/204
2002/0039300 A1 * 4/2002 Takeuchi et al. ..... 363/60
2002/0132383 A1 * 9/2002 Hiroki et al. ..... 438/17
2003/0001833 A1 * 1/2003 Hunter ..... 345/212
2003/0044678 A1 * 3/2003 Winarski ..... 429/162

* cited by examiner

*Primary Examiner*—Jeffery A. Brier
*Assistant Examiner*—Eric Woods
(74) *Attorney, Agent, or Firm*—Rabin & Berdo, PC

(57) ABSTRACT

An apparatus for recycling energy in a liquid crystal display (LCD) so as to reduce energy loss when the LCD is driven by a driving circuit. The LCD includes two pixels, each of which has a corresponding capacitor and has a corresponding voltage applied to. The polarities of the voltages of the two corresponding capacitors are variable with time and are opposite to each other. The apparatus includes two switches and an energy converter. The two switches are used for selectively coupling the respective capacitors to the apparatus. The energy converter is used for outputting converted energy according to the voltages of the two capacitors. By enabling the first switch and the second switch selectively, the apparatus recycles energy dissipated during polarity inversion for the two pixels as energy for driving a load device.

12 Claims, 4 Drawing Sheets

| | | | |
|---|---|---|---|
| + | + | + | + |
| + | + | + | + |
| + | + | + | + |
| + | + | + | + |

FIG. 1A
(PRIOR ART)

| | | | |
|---|---|---|---|
| − | − | − | − |
| − | − | − | − |
| − | − | − | − |
| − | − | − | − |

FIG. 1B
(PRIOR ART)

| | | | |
|---|---|---|---|
| + | \| | + | \| |
| + | \| | + | \| |
| + | \| | + | \| |
| + | \| | + | \| |

FIG. 1C
(PRIOR ART)

| | | | |
|---|---|---|---|
| \| | + | \| | + |
| \| | + | \| | + |
| \| | + | \| | + |
| \| | + | \| | + |

FIG. 1D
(PRIOR ART)

| | | | |
|---|---|---|---|
| + | − | + | − |
| − | + | − | + |
| + | − | + | − |
| − | + | − | + |

FIG. 1E
(PRIOR ART)

| | | | |
|---|---|---|---|
| − | + | − | + |
| + | − | + | − |
| − | + | − | + |
| + | − | + | − |

FIG. 1F
(PRIOR ART)

APPARATUS FOR RECYCLING ENERGY IN A LIQUID CRYSTAL DISPLAY

This application incorporates by reference Taiwan application Serial No. 090132094, filed on Dec. 24, 2001.

BACKGROUND OF THE INVENTION

1. Field of the Invention

The invention relates in general to an apparatus for reducing energy loss, and more particularly to an apparatus for saving energy in a liquid crystal device (LCD).

2. Description of the Related Art

The progress of display technology brings more innovative display devices for users. Because LCDs are low radiation, low power, and compact, they are gradually substituted for higher radiation, larger, conventional cathode ray tube (CRT) displays in the high-end market. Nowadays, notebook computers and projectors are equipped with LCDs. Besides, more and more desktop computers' users select LCD monitors to substitute for conventional CRT displays.

The display panel of an LCD is formed with a front plate, a rear plate, and the cavity between the front and the rear plates, wherein the cavity between the front and the rear plates is filled with liquid crystal molecules. In a typical transmissive LCD, its display panel is equipped with a back lighting source. The fraction of light transmitting through the display panel is called light transmissivity. The light transmissivity determines the brightness of the display panel. In addition, how the liquid crystal molecules in the cavity between the front and the rear plates are arranged determines the light transmissivity of the display panel. Further, the arrangement of these liquid crystal molecules depends on the voltage across the front and the rear plates. Thus, the brightness of the display panel can be controlled by applying different voltage across the front and the rear plates.

It should be noted that the light transmissivity of the liquid crystal molecules is only related to the value of voltage across the front and the rear plates, and is not related to the polarity of the voltage applied to the front and the rear plates. For example, if a pixel is supplied with two voltages separately in the same value but opposite in polarity, the pixel will have the same light transmissivity correspondingly. In particular, if voltages in the same polarity are continually applied to the pixels of the LCD, the liquid crystal molecules of the pixels may deteriorate. Since the light transmissivity of pixels is independent of the polarities of voltages applied to the pixels, the liquid crystal molecules can be prevented from deteriorating by alternately changing the polarity of the voltages applied to them. Such approaches are called polarity inversion.

In terms of polarity inversion, driving methods for typical LCD display panels can be categorized into three methods as follows: frame inversion, column inversion, and dot inversion. The following is their brief descriptions.

FIGS. 1A–1F respectively show a portion of the pixels of a display panel driven by different polarity inversion driving methods. The portion of pixels is indicated by squares, and plus (+) or minus (−) signs in the squares indicate that the associated pixels are supplied with positive voltages or negative voltages, individually. FIGS. 1A and 1B illustrate the frame inversion driving method for driving a display panel. Alternately, if all pixels of the display panel are fed with positive voltages at a time instant, as shown in FIG. 1A, negative voltages are fed into the pixels at the next time instant, as shown in FIG. 1B. This driving method is to alternately change polarity of all the applied voltages to the pixels of the whole display panel and is thus referred to as the frame inversion driving method.

FIGS. 1C and 1D illustrate the column inversion driving method for driving the display panel. At a time instant, some column of pixels, such as even pixel columns, are supplied with positive voltages while the other pixel columns, such as odd pixel columns, are supplied with negative voltages, as shown in FIG. 1C. At the next time instant, the even pixel columns are supplied with negative voltages while the odd pixel columns are supplied with positive voltages, as shown in FIG. 1D. Since the polarities of voltages applied to the pixels of the display panel are changed on the basis of whole lines (e.g., columns), this driving method is called the column inversion driving method.

FIGS. 1E and 1F illustrate the dot inversion driving method for driving the display panel. In this driving method, every pixel can be viewed as a dot, and every dot is surrounded by other dots with voltages in inverse polarity. That is, if a pixel is supplied with a negative voltage, the adjacent pixels are supplied with respective positive voltages. At the next time instant, the polarities of each of the pixels will be changed.

The polarity inversion driving methods described above can avoid the liquid crystal molecules from deteriorating and can improve the display quality of the LCD panel. However, a large amount of energy loss would occur in the driving circuit of the LCD panel when voltages applied across the front and the rear plates drop and rise between inverse polarities.

FIG.2 shows a portion of the equivalent circuitry of an LCD panel driven by a driving circuit using column inversion or dot inversion. Suppose that when a pixel 202 and a pixel 204 have identical brightness, the pixel voltage $V_{C1}$ across the capacitor C1 of the pixel 202 and the pixel voltage $V_{C2}$ across the capacitor C2 of the pixel 204 are equal in value and opposite in polarity. Referring to FIG. 2, a conventional method of reducing energy loss in polarity inversion uses transmission gates coupled between two adjacent data lines, such as a transmission gate 206 coupled between adjacent data lines D1 and D2. At time t1, the driving circuit enables a scan line S and turns on the transmission gate 206. In this way, the pixel capacitors C1 and C2 are electronically coupled together; one of them will discharge and the other will be charged so that the pixel voltages $V_{C1}$ and $V_{C2}$ of the two pixel capacitors C1 and C2 approach to $(V_{C1}+V_{C2})/2$. This process is referred to as charge sharing. At time t2, voltages in polarities opposite to that at the time t2 are fed into the data lines D1 and D2 respectively to change the pixel voltages $V_{C1}$ and $V_{C2}$ into pixel voltages $V_{C1}'$ and $V_{C2}'$ opposite to the pixel voltages $V_{C1}$ and $V_{C2}$ in polarity, respectively. In other words, before the polarity inversion for the pixels, the pixel voltages of the pixel capacitors C1 and C2 have been made nearly equal to the average of the pixel voltages at the time t1 so that, during polarity inversion, the changes in the pixel voltages of the pixel capacitors C1 and C2 are made smaller than the conventional ones. Thus, the energy loss is reduced during polarity inversion.

The conventional method above results in reduced energy loss. However, the saved energy is small as compared to the total energy loss and an amount of energy is still dissipated in the form of heat. The operating temperature of the LCD is then increased with time. If the operating temperature is higher than a maximum operating temperature, the performance of the internal circuits would be degraded and the lifetime of the LCD would be shortened.

SUMMARY OF THE INVENTION

It is therefore an object of the invention to provide an apparatus for reducing energy loss in an LCD so as to save energy during polarity inversion for the LCD panel.

The invention achieves the above-identified object by providing an apparatus for recycling energy in an LCD so as to reduce energy loss when the LCD is driven by a driving circuit. The LCD includes a first pixel and a second pixel, wherein the first and the second pixels have a first pixel capacitor and a second pixel capacitor respectively. In addition, when the LCD is in operation, a first pixel voltage and a second pixel voltage are applied to the first and the second pixel respectively, wherein the polarities of the first and the second pixel voltages are variable with time and are opposite to each other. The apparatus includes a first switch, a second switch, and an energy converter. The first switch is coupled to the first pixel capacitor, and is used for selectively coupling the first pixel capacitor to the apparatus. The second switch is coupled to the second pixel capacitor, and is used for selectively coupling the second pixel capacitor to the apparatus. The energy converter is coupled to the first switch and the second switch, and is used for outputting converted energy according to the first and the second pixel voltages, wherein the energy converter determines the form and the magnitude of the converted energy according to a load device coupled to the energy converter. By enabling the first switch and the second switch selectively, the apparatus recycles energy dissipated during polarity inversion for the first and the second pixels as the converted energy for driving the load device.

Other objects, features, and advantages of the invention will become apparent from the following detailed description of the preferred but non-limiting embodiments. The following description is made with reference to the accompanying drawings.

BRIEF DESCRIPTION OF THE DRAWINGS

FIGS. 1A–1B (Prior Art) illustrate a portion of an LCD panel driven by a driving method of frame inversion.

FIGS. 1C–1D (Prior Art) illustrate a portion of an LCD panel driven by a driving method of column inversion.

FIGS. 1E–1F (Prior Art) illustrate a portion of an LCD panel driven by a driving method of dot inversion.

DETAILED DESCRIPTION OF THE INVENTION

The principle of the invention is to receive energy dissipated during polarity inversion for the pixel capacitors of a display panel through an energy recycling device, and to convert the received energy into energy for driving a load device coupled to the energy recycling device. In this way, energy recycling is achieved and energy loss is reduced to a minimum level.

Figure 2:
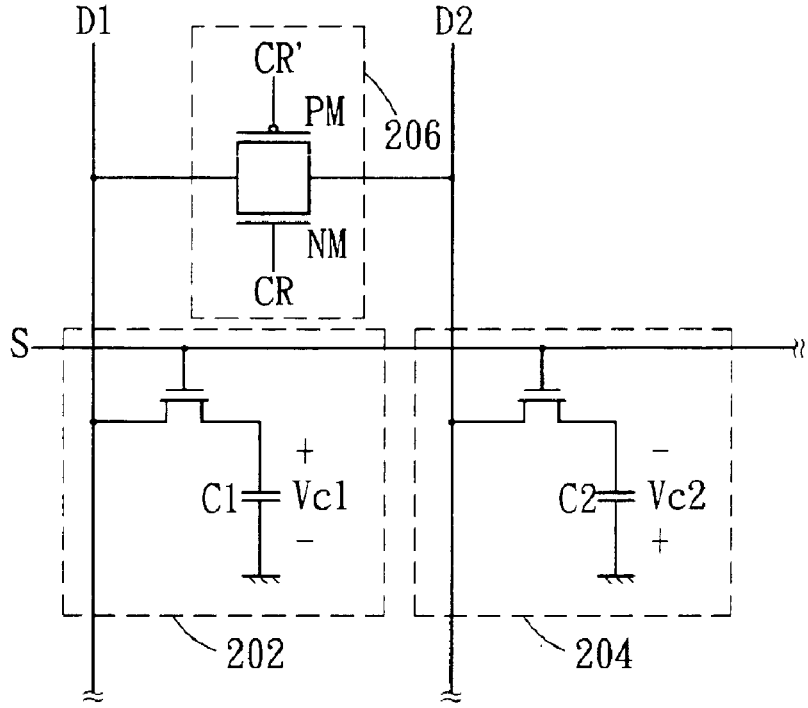
FIG. 2 (PRIOR ART)
FIG. 2 (Prior Art) illustrates the circuitry of a conventional charge sharing method for reducing energy loss during driving an LCD panel.
Figure 3:
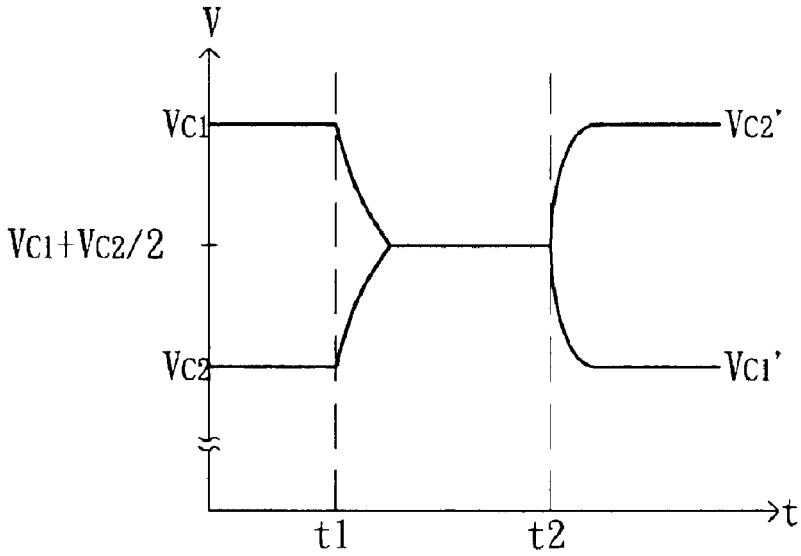
FIG. 3 (PRIOR ART)
FIG. 3 (Prior Art) shows a timing diagram illustrating two adjacent pixels' voltages during polarity inversion by using the charge sharing method.
Figure 4:
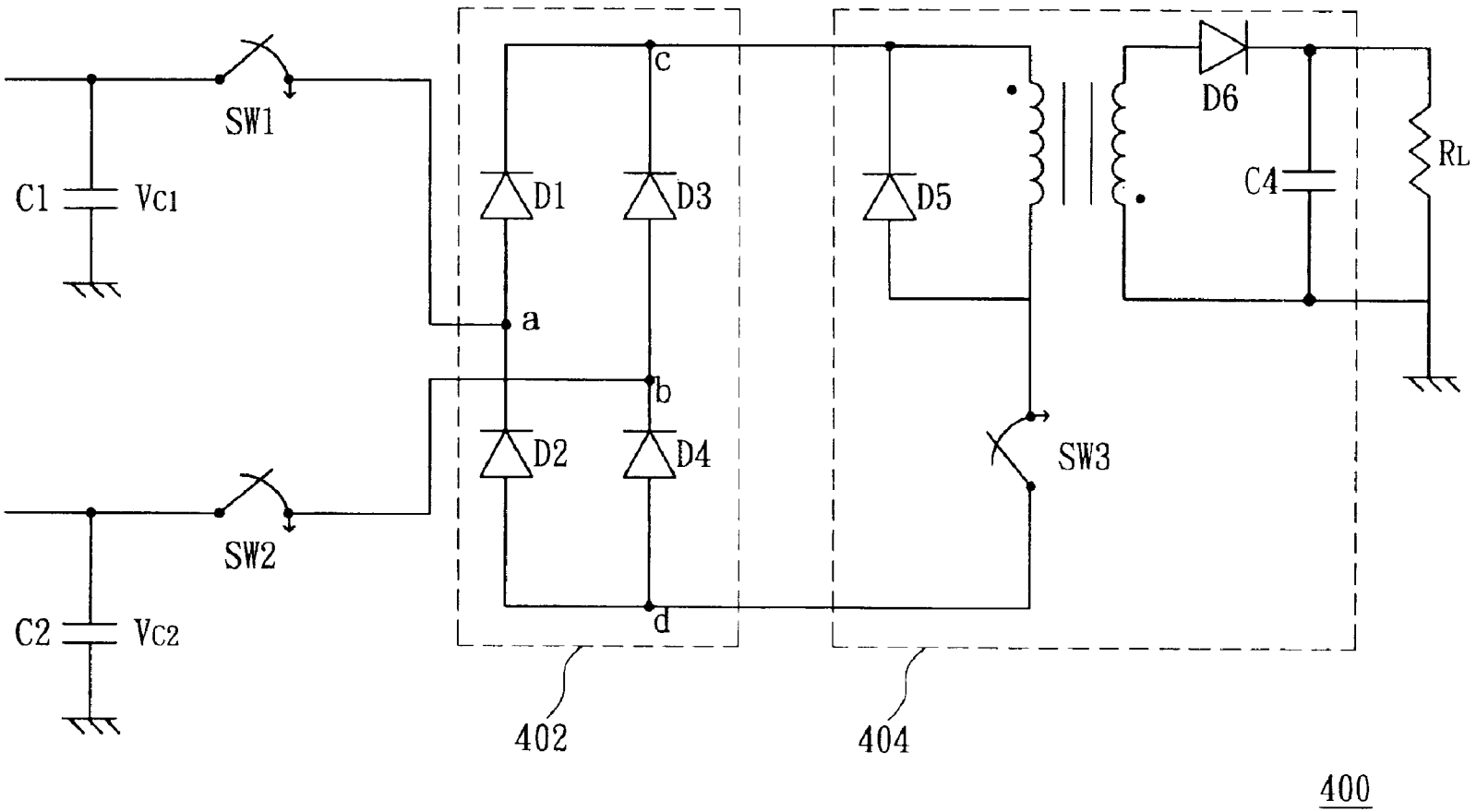
FIG. 4 shows a circuit diagram illustrating an apparatus for recycling energy in an LCD, according to an embodiment of the invention.

Suppose that a driving circuit drives the LCD panel by using column inversion or dot inversion. The polarities of the pixel voltages $V_{C1}$ and $V_{C2}$ of the pixel capacitors C1 and C2 of two adjacent pixels change with time alternately respectively and are opposite to each other. A circuit diagram shown in FIG. 4 illustrates an energy recycling device 400 for use in the LCD panel, according to the invention. The energy recycling device 400 includes control switches SW1 and SW2, and an energy converter. The energy converter includes a rectifier 402 and a DC-to-DC converter 404, for example. When the driving circuit performs polarity inversion on the pixels of the LCD panel, the control switches SW1 and SW2 are turned on. The control switches SW1 and SW2 may be transmission gates, for example. When the control switches C1 and C2 are turned on, the rectifier 402 is electronically coupled to the pixel capacitors C1 and C2 individually. The rectifier 402 is used for outputting a DC voltage in the same polarity according to the pixel voltages $V_{C1}$ and $V_{C2}$, and independent of the polarities of pixel voltages $V_{C1}$ and $V_{C2}$.

As shown in FIG. 4, the rectifier 402 is formed with four diodes, namely, D1, D2, D3, and D4. The anode of the diode D1 and the cathode of the diode D2 is connected at node a; the anode of the diode D3 and the cathode of the diode D4 is connected at node b. The cathodes of the diodes D1 and D3 are connected at node c; the anodes of the diodes D2 and D4 are connected at node d. By the operation of the four diodes of the rectifier 402, the voltage between nodes c and d, referred to as rectified voltage $V_{CD}$, is equal to the difference of the pixel voltages $V_{C1}$ and $V_{C2}$, independent of the polarities of the pixel voltages $V_{C1}$ and $V_{C2}$. In addition, the voltage VC at node c is greater than the voltage VD at node d. In other words, the rectified voltage $V_{CD}$ outputted from the rectifier 402 is a DC voltage, independent of the polarities of the pixel voltages $V_{C1}$ and $V_{C2}$.

The DC-to-DC converter 404 is coupled to the rectifier 402 and is used for converting the rectified voltage $V_{CD}$ from the rectifier 402 into another form of energy. The DC-to-DC converter 404 can be a boost converter, a buck converter, or any other DC-to-DC converter. In this embodiment, a flyback DC-to-DC converter is taken as the DC-to-DC converter 404. The DC-to-DC converter 404 is used to adjust the voltage level of its input DC voltage and maintain its output in a predetermined voltage value. In addition, there is no energy loss during the adjustment of the voltage level, theoretically. The DC-to-DC converter 404 can be divided into the input side and the output side. For insulation of the input and the output sides, a transformer may be coupled between the both sides. Take the flyback DC-to-DC converter for example; its input side includes a diode D5, a control switch SW3, and the primary winding of the transformer, while its output side includes a diode D6, a capacitor C4, and the secondary winding of the transformer, as shown in FIG. 4. The flyback DC-to-DC converter is controlled through the control switch SW3. When the control switch SW3 is turned on, electrical energy is outputted by the rectifier 402 in the form of the rectified voltage $V_{CD}$ and is stored in the windings of the transformer in the form of magnetic energy. When the control switch SW3 is turned on, the current flows through the primary winding of the transformer from node c to the control switch SW3. In this way, charge sharing is substantially performed between the pixel capacitors C1 and C2 of two adjacent pixels. When the control switch SW3 is turned off, the electric energy outputted by the rectifier 402 can be transferred to the secondary winding in the form of DC voltage. By periodically switching on and off the control switch SW3, the DC-to-DC converter 404 can output a DC voltage, referred to as converted voltage $V_O$, according to the rectified voltage $V_{CD}$. Note that the converted voltage $V_O$ outputted by the DC-to-DC converter 404 and the rectified voltage $V_{CD}$ fed into the DC-to-DC converter 404 are related to the ratio of the turn numbers of the primary and the secondary windings, and the duty cycle for switching the control switch SW3. In other words, the value of the converted voltage $V_O$ outputted by the DC-to-DC converter 404 can be determined by adjusting the ratio of turn numbers of the primary and the secondary windings, and the duty cycle for switching the control switch SW3. In theory, the flyback DC-to-DC converter does not cause energy loss during a rise in voltage. Further, the value of the converted voltage $V_O$ outputted by the DC-to-DC converter 404 depends on the operating voltage of a back-end load device.

Additionally, a load device, such as a device having a resistance of $R_L$ shown in FIG. 4, is coupled to the DC-to-DC converter 404. The load device may be different kind of load, depending on the needs and design goal of the system where the energy recycling device is used. For example, the power supply of the LCD may be designed as the load device so that the power supply can recycle energy that the power supply provides to the LCD. In another example, the load device may be a piece of portable equipment, such as a rechargeable battery for a notebook computer. In this example, the converted voltage $V_O$ outputted by the energy recycling device 400 can be used to charge the rechargeable battery. In this way, energy recycling is achieved.

Figure 5:
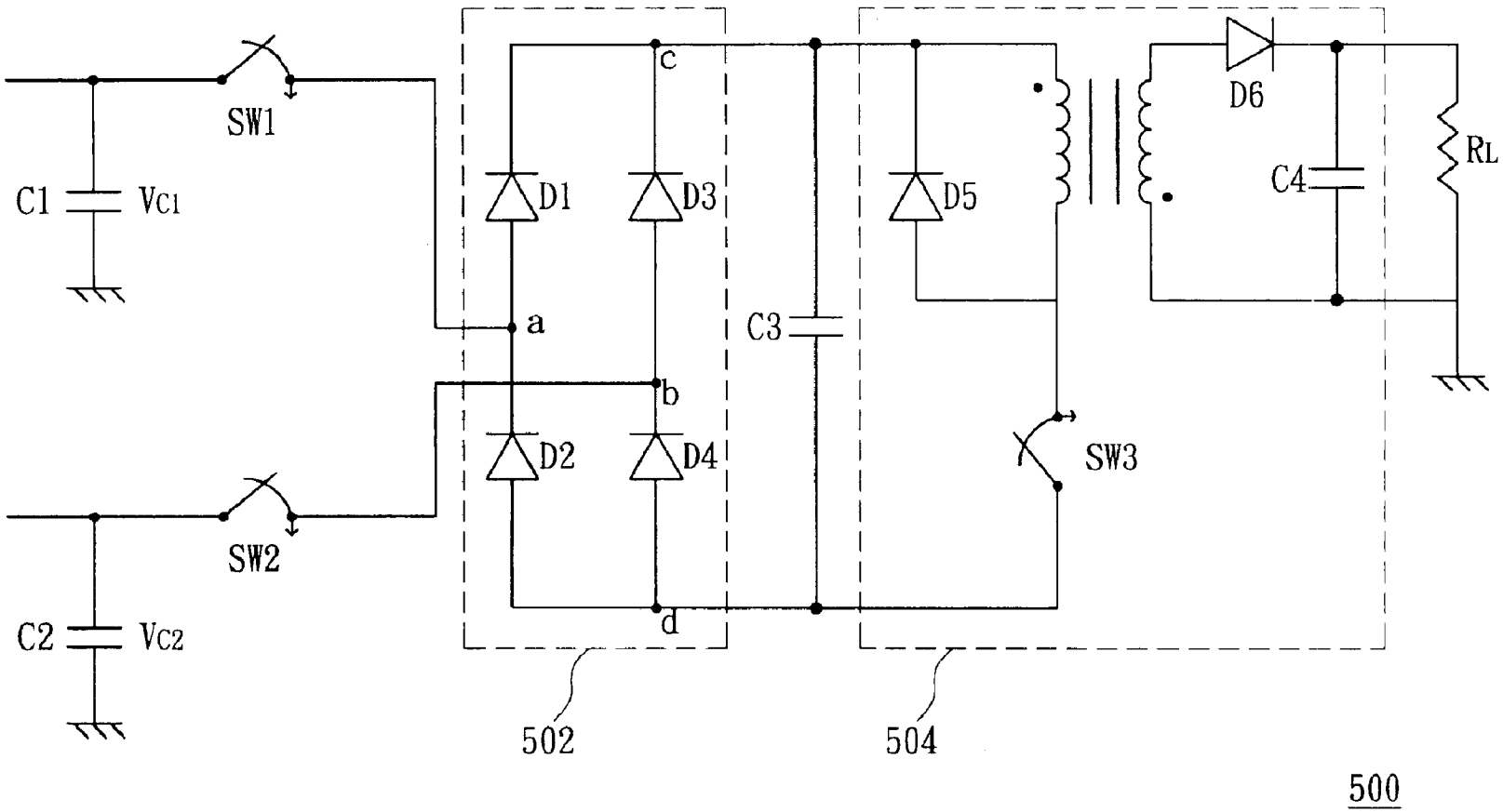
FIG. 5 shows a circuit diagram illustrating an apparatus for recycling energy in an LCD, according to another embodiment of the invention.

Another energy recycling device is shown in FIG. 5 according to the invention, wherein a rectifier 502 and a DC-to-DC converter 504 are identical to the rectifier 402 and the DC-to-DC converter 404 shown in FIG. 4. Based on the energy recycling device 400 in FIG. 4, the energy recycling device 500 in FIG. 5 has a capacitor C3 of large capacitance additionally which is coupled between node c and node d and is referred to as a conversion capacitor. By the help of the conversion capacitor, when polarity inversion is in operation, the speed of charge sharing can be increased, improving the efficiency of energy conversion.

It should be noted that in addition to the energy converter disclosed above, the energy converter may be formed with a transformer, a charge pump, or a switching capacitor, for example. Any device that is capable of converting energy dissipated during polarity inversion for pixel capacitors of the LCD panel into a reusable form of energy and outputting the reusable form of energy may be used under the scope of the invention.

As disclosed above, the energy recycling device according to the embodiment of the invention can reduce much energy dissipation as compared with the conventional approach. In addition, the energy recycling device can convert energy dissipated during polarity inversion for pixel capacitors of the LCD panel into a reusable form of energy so as to drive the load device. Thus, the energy recycling is further achieved.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An apparatus for recycling energy in a liquid crystal display (LCD) so as to reduce energy loss when the LCD is driven by a driving circuit, the LCD including a first pixel and a second pixel, the first pixel having a first pixel capacitor and the second pixel having a second pixel capacitor, wherein when the LCD is in operation, a first pixel voltage and a second pixel voltage are applied to the first pixel and the second pixel respectively, the polarities of the first and the second pixels are variable with time and are inverse to each other, the apparatus comprising:

a first switch, coupled to the first pixel capacitor, for selectively coupling the first pixel capacitor to the apparatus;

a second switch, coupled to the second pixel capacitor, for selectively coupling the second pixel capacitor to the apparatus; and an energy converter which includes a rectifier coupled to the first switch and the second switch, the rectifier outputting a rectified voltage which is a direct current (DC) voltage according to the first pixel voltage and the second pixel voltage, the energy converter outputting converted energy according to the rectified voltage in a form and magnitude determined according to a load device coupled to the energy converter;

wherein the apparatus recycles energy dissipated during polarity inversion for the first pixel and the second pixel as the converted energy for driving the load device by enabling the first switch and the second switch selectively.

2. The apparatus according to claim 1, wherein the rectifier comprises:

a first diode having an anode and a cathode;

a second diode having an anode and a cathode, the cathode of the second diode being coupled to the anode of the first diode at a first node;

a third diode having an anode and a cathode, the cathode of the third diode being coupled to the cathode of the first diode at a third node; and a fourth diode having an anode and a cathode, the cathode of the fourth diode being coupled to the anode of the third diode at a second node, and the anode of the fourth diode being coupled to the anode of the second diode at a fourth node;

wherein the first switch is coupled to the rectifier at the first node, and the second switch is coupled to the rectifier at the second node.

3. The apparatus according to claim 2, wherein the DC-to-DC converter is a buck converter, and input terminals of the buck converter are coupled to the third node and the fourth node respectively.

4. The apparatus according to claim 2, wherein the DC-to-DC converter is a boost converter, and input terminals of the boost converter are coupled to the third node and the fourth node respectively.

5. The apparatus according to claim 2, wherein the DC-to-DC converter is a flyback converter, and input terminals of the flyback converter are coupled to the third node and the fourth node respectively.

6. The apparatus according to claim 2, wherein the rectifier further includes a capacitor, and two terminals of the capacitor are coupled to the third node and the fourth node respectively.

7. The apparatus according to claim 1, wherein the first switch and the second switch are transmission gates.

8. The apparatus according to claim 1, wherein the load device is a power source for the LCD.

9. The apparatus according to claim 1, wherein the load device is a rechargeable battery.

10. The apparatus according to claim 9, wherein the rechargeable battery is for use in a piece of portable equipment.

11. The apparatus according to claim 1, wherein the driving circuit drives the LCD by using a column inversion driving method.

12. The apparatus according to claim 1, wherein the driving circuit drives the LCD by using a dot inversion driving method.

* * * * *

UNITED STATES PATENT AND TRADEMARK OFFICE

CERTIFICATE OF CORRECTION

PATENT NO. : 6,999,050 B2
DATED : February 14, 2006
INVENTOR(S) : Kun-Chen Hung et al.

It is certified that error appears in the above-identified patent and that said Letters Patent is hereby corrected as shown below:

Title page,
Item [73], Assignee, should read -- Chi Mei Optoelectronics Corp. --.

Signed and Sealed this

Sixteenth Day of May, 2006

JON W. DUDAS
*Director of the United States Patent and Trademark Office*